US010262599B2

(12) United States Patent
Lang et al.

(10) Patent No.: US 10,262,599 B2
(45) Date of Patent: Apr. 16, 2019

(54) DISPLAY BACKLIGHT BRIGHTNESS ADJUSTMENT

(71) Applicant: Intel Corporation, Santa Clara, CA (US)

(72) Inventors: John Lang, Hillsboro, OR (US); Yunhui Chu, Portland, OR (US); Yanli Zhang, San Jose, CA (US); Zhiming J. Zhuang, Sammamish, WA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/468,389

(22) Filed: Mar. 24, 2017

(65) Prior Publication Data

US 2018/0277046 A1 Sep. 27, 2018

(51) Int. Cl.
*G09G 3/34* (2006.01)

(52) U.S. Cl.
CPC ... *G09G 3/3406* (2013.01); *G09G 2320/0646* (2013.01); *G09G 2330/021* (2013.01)

(58) Field of Classification Search
CPC ..... G09G 3/3406; G09G 3/3426; G09G 2320/062; G09G 2320/0626; G09G 2320/0646; G09G 2330/021
See application file for complete search history.

(56) References Cited

U.S. PATENT DOCUMENTS 9,740,046 B2 * 8/2017 Wyatt ..... G02F 1/133603
2010/0002466 A1 * 1/2010 Kim ..... G02B 6/003 362/615
2010/0309109 A1 * 12/2010 Won ..... G09G 3/3426 345/102
2011/0181202 A1 * 7/2011 Yu ..... G09G 3/3426 315/297

OTHER PUBLICATIONS

Glendinning et al., U.S. Appl. No. 15/201,360, filed Jul. 1, 2016, US Application, Drawings, and E-Ack Receipt attached 42 pages, not yet published.

* cited by examiner

*Primary Examiner* — Kenneth Bukowski
(74) *Attorney, Agent, or Firm* — International IP Law Group, P.L.L.C.

(57) ABSTRACT

In some examples, a display includes a plurality of display backlight groups, and one or more controller to determine one or more one-dimensional backlight group brightness level adjustments, to determine one or more two-dimensional backlight group brightness level adjustments, and to adjust a brightness of one or more of the backlight groups in response to content of a display image.

25 Claims, 9 Drawing Sheets

400

100

200B

200A

| | | | | | | | |
|---|---|---|---|---|---|---|---|
| 8 | 8 | 8 | 8 | 8 | 8 | 7 | 7 |
| 8 | 8 | 7 | 7 | 6 | 6 | 6 | 6 |
| 7 | 7 | 7 | 7 | 6 | 6 | 6 | 6 |
| 7 | 8 | 8 | 7 | 7 | 7 | 4 | 4 |
| 4 | 8 | 5 | 3 | 3 | 3 | 2 | 2 |
| 1 | 2 | 2 | 2 | 2 | 2 | 2 | 2 |
| 0 | 0 | 0 | 0 | 0 | 0 | 0 | 0 |

200C

FIG. 2C

| | | | | | | | |
|---|---|---|---|---|---|---|---|
| 4 | 4 | 4 | 4 | 4 | 4 | 4 | 4 |
| 4 | 4 | 3 | 3 | 2 | 2 | 3 | 3 |
| 3 | 3 | 3 | 3 | 2 | 2 | 3 | 3 |
| 3 | 4 | 4 | 3 | 3 | 3 | 1 | 1 |
| 0 | 4 | 1 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

200D

FIG. 2D

| | | | | | | | |
|---|---|---|---|---|---|---|---|
| 4 | 4 | 4 | 4 | 4 | 4 | 3 | 3 |
| 4 | 4 | 3 | 3 | 2 | 2 | 2 | 2 |
| 4 | 4 | 4 | 4 | 3 | 3 | 3 | 3 |
| 3 | 4 | 4 | 3 | 3 | 3 | 0 | 0 |
| 0 | 4 | 1 | 0 | 0 | 0 | 0 | 0 |
| 0 | 1 | 1 | 1 | 1 | 1 | 1 | 1 |
| 0 | 0 | 0 | 0 | 0 | 0 | 0 | 0 |

200E

FIG. 2E

DISPLAY BACKLIGHT BRIGHTNESS ADJUSTMENT

TECHNICAL FIELD

This disclosure relates generally to adjusting display backlight brightness.

BACKGROUND

Displays such as Liquid Crystal Displays (LCDs) can use groups of light-emitting diode (LED) lights to provide a backlight for the display. Many display systems do not have any backlight dimming control. Without backlight dimming control, the brightness of the backlight LEDs might be kept at a maximum level regardless of whether the image being displayed is dark or bright. In such a display system, most of the light energy can turn into heat, and power efficiency can suffer when the image or part of the image is relatively dark.

BRIEF DESCRIPTION OF THE DRAWINGS

The following detailed description may be better understood by referencing the accompanying drawings, which contain specific examples of numerous features of the disclosed subject matter.

FIG. 2, which includes FIG. 2A, FIG. 2B, FIG. 2C, FIG. 2D, and FIG. 2E, illustrates image partitioning;

FIG. 3, which includes

In some cases, the same numbers are used throughout the disclosure and the figures to reference like components and features. In some cases, numbers in the 100 series refer to features originally found in FIG. 1; numbers in the 200 series refer to features originally found in FIG. 2; and so on.

DESCRIPTION OF THE EMBODIMENTS

Some embodiments relate to display control.

Some embodiments relate to display backlight brightness adjustment. For example, some embodiments relate to display backlight dimming. Some embodiments relate to Liquid Crystal Display (LCD) backlight brightness adjustment and/or LCD backlight dimming.

As discussed above, in a display system that does not provide backlight dimming, most of the light energy from groups of backlight light-emitting diodes (groups of backlight LEDs) can turn into heat, and power efficiency can suffer when the image or part of the image is relatively dark, for example. In some embodiments, backlight dimming can include providing current to each individual group of backlight LEDs in order to provide a low total power consumption without compromising quality of a display image. For example, in some embodiments, a final backlight distribution on a display surface satisfies a brightness need of each pixel in the display image. In some embodiments, backlight dimming can be provided in a manner that can improve backlight LED life times.

In some embodiments, a brightness of each of a number of display backlight groups (for example, each of a number of LED backlight groups) can be adjusted (for example, can be dimmed). In some embodiments, a control voltage for display image pixels can be adjusted in response to an adjustment in display backlight brightness.

In some embodiments, segmented backlight driving can be implemented (for example, to adjust brightness levels of various segments of a display backlight dynamically and/or independently). In some embodiments, display backlight brightness can be adjusted dynamically based on display image content. In some embodiments, backlight brightness can be adjusted individually for each of a plurality of sub-regions of a display backlight. In some embodiments, backlight brightness can be continuously updated for each display image (for example, separately adjusted for each frame in a video image to be displayed on a display). In some embodiments, a backlight brightness profile can be calculated for each pixel of an image. In some embodiments, a backlight brightness profile can be calculated for each of a number of small groups of pixels of an image. In some embodiments, a pixel brightness distribution of the image can be adjusted in response to backlight dimming level adjustment and/or in response to a backlight brightness profile (for example, for each pixel in the image, or for each of a number of small groups of pixels in the image).

Figure 1:
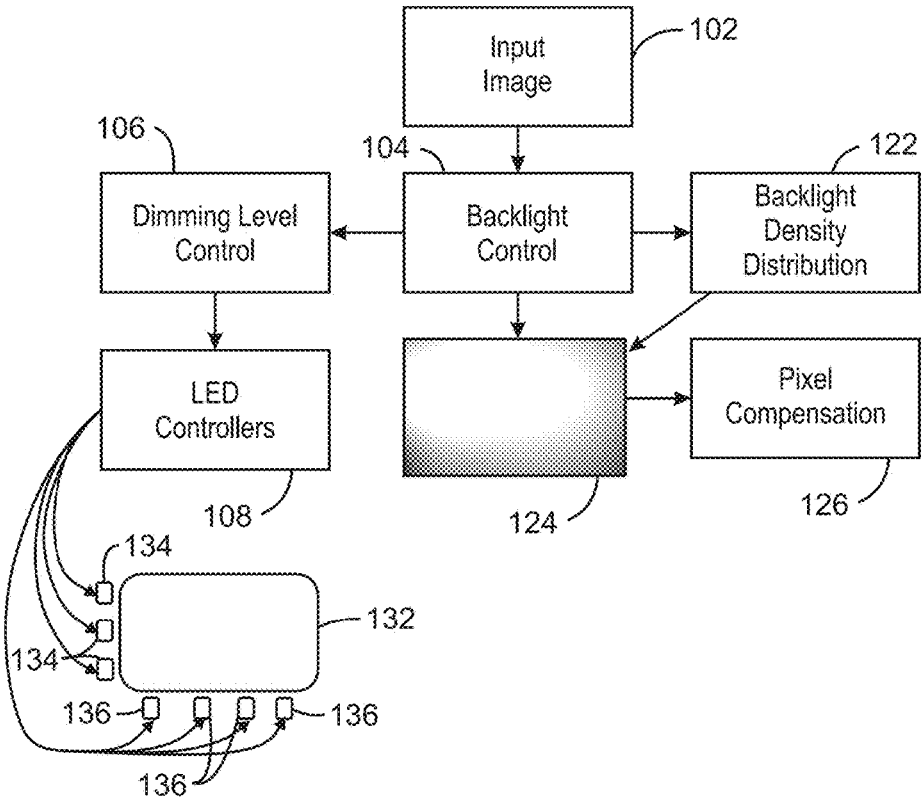
FIG. 1 illustrates a display control system.

FIG. 1 illustrates system 100 (for example, a display backlight control system and/or a display control system) to control backlight dimming and/or image pixel compensation. In some embodiments, system 100 includes an input image 102 (for example, an input image frame 102), backlight control 104, dimming level control 106 (for example, implementing dimming level control for each or a plurality of backlight groups), one or more light emitting diode (LED) controllers 108, backlight density distribution control 122 (and/or backlight brightness profile control 122), backlight brightness profile 124, pixel compensator 126 (and/or liquid crystal display pixel control compensation 126), backlight 132, backlight light-emitting diode (LED) groups 134, and/or backlight LED groups 136.

In some embodiments, two or more of backlight controller 104, dimming level controller 106, LED controller 108, backlight density distribution controller 122 and/or pixel compensation controller 126 are included in the same controller. In some embodiments, one or more of backlight controller 104, dimming level controller 106, LED controller 108, backlight density distribution controller 122 and/or pixel compensation controller 126 are implemented in a display controller. In some embodiments, one or more of backlight controller 104, dimming level controller 106, LED controller 108, backlight density distribution controller 122 and/or pixel compensation controller 126 are implemented in a display backlight controller. In some embodiments, one or more of backlight controller 104, dimming level controller 106, LED controller 108, backlight density distribution controller 122 and/or pixel compensation controller 126 are included in a display device (for example, in an LCD control module). In some embodiments, one or more of backlight controller 104, dimming level controller 106, LED controller 108, backlight density distribution controller 122 and/or pixel compensation controller 126 are included in a display interface. In some embodiments, one or more of backlight controller 104, dimming level controller 106, LED controller 108, backlight density distribution controller 122 and/or pixel compensation controller 126 are included in a host device.

In some embodiments, as illustrated in FIG. 1, three row backlight LED groups 134 and four column backlight LED groups 136 are illustrated. However, in some embodiments, any number of row backlight LED groups 134 and any number of column backlight LED groups 136 may be included. For example, some embodiments can include seven row backlight LED groups 134 and/or eight column backlight LED groups 136.

In some embodiments, system 100 includes backlight LED groups 134 and 136 placed at and/or near left and bottom edges, respectively, of a display such as a liquid crystal display (LCD). In some embodiments, LED groups can be placed at and/or near other edges of a display. For example, in some embodiments, LED groups can be placed at and/or near edges that are next to and/or perpendicular to each other. In some embodiments, LED groups can be placed at and/or near top and side edges. In some embodiments, LED groups can be placed at and/or near three edges, or four edges, etc.

In some embodiments, LED backlight groups are edge-lite type of backlight groups, with a thin display and/or backlight. In some embodiments, all elements of system 100 and/or the backlight LED groups 134 and/or 136 are included in one or more of a mobile device, a phone, a phablet, a notebook, an all in one computing device, or a television, among others.

In many such display devices, power consumption of the display can be a very significant factor affecting power requirements and/or battery life. In some embodiments, backlight dimming can be implemented by controlling current for each backlight group such as backlight LED groups 134 and 136. In some embodiments, backlight dimming can be implemented by individually controlling current for each backlight group such as backlight LED groups 134 and 136. In some embodiments, current provided to each backlight group 134 and/or 136 (for example, placed at and/or near bottom and vertical edges of a display screen) can be optimized. In some embodiments, current provided to each backlight group 134 and/or 136 can be optimized, and total power consumption for a given image can be minimized, for example, without comprising image quality. In some embodiments, the life of the LEDs in the LED groups 134 and/or 136 can be improved (for example, in response to optimization of current provided to the backlight LED groups). In some embodiments, backlight controller 104 can perform partitioning of input image 102 (for example, into sub-regions based on a number of LED groups such as backlight LED groups 134 and/or 136). In some embodiments, backlight controller 104 and/or dimming level controller 106 can implement backlight dimming optimization (for example, to optimize current to be provided by one or more LED controllers 108 to the backlight LED groups 134 and/or 136). In some embodiments, backlight controller 104 and/or backlight density distribution controller 122 can calculate a total brightness distribution (for example, based on an actual profile of each LED group). In some embodiments, backlight controller 104, dimming level controller 106 and/or backlight density distribution controller 122 can implement dimming level adjustment for non-ideal beam profiles. In some embodiments, once dimming levels for LED groups 134 and/or 136 have been determined after dimming level adjustment, and a final brightness distribution has been calculated, pixel compensation device 126 can compensate image pixels (for example, using an actual pixel transmittance ratio such as an LCD transmittance ration). In some embodiments, dimming level adjustment for non-ideal beam profiles and/or pixel compensation can be implemented for each individual pixel in the display image. In some embodiments, dimming level adjustment for non-ideal beam profiles and/or pixel compensation can be implemented for groups of pixels in the display image (for example, for small groups of pixels such as 10 pixels per group, 20 pixels per group, or some other number of pixels per group). In some embodiments, pixel compensation controller 126 can adjust voltage control to adjust individual pixels and/or small groups of pixels in a display image (for example, in an LCD display image).

Figure 2B:
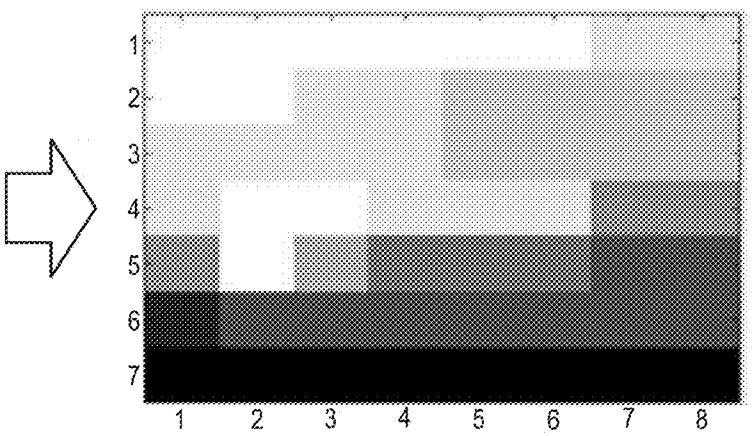
Figure 2A:
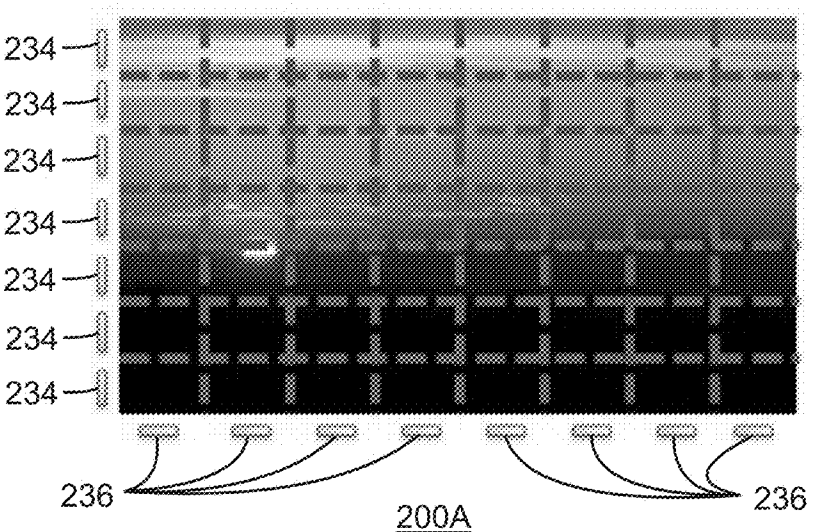

According to some embodiments, FIG. 2A illustrates an original image 200A partitioned into 8 by 7 (56) sub-regions. In some embodiments, FIG. 2B illustrates a grayscale image 200B representation of backlight brightness that may be used for each sub-region of the image 200A. In some embodiments, FIG. 2C illustrates a numerical representation 200C of brightness levels for each of the sub-regions. In some embodiments, the numerical representations of FIG. 2C for each sub-region correspond to the grayscale representations of FIG. 2B for that sub-region. In some embodiments, FIG. 2D illustrates a numerical representation 200D of brightness levels to be used for each sub-region, for example, when the brightness levels in numerical representation 200D represent a portion of backlight brightness that may be used for each sub-region. Although particular brightness level values are illustrated and described in reference to figures such as FIG. 2A, FIG. 2B, FIG. 2C and FIG. 2D, it is noted that these values are provided in some example embodiments, and that other values can be used in some embodiments. For example, the brightness values, the range of brightness values, and/or number of brightness values used herein can be any variety of numbers, values, combinations, etc. according to some embodiments.

FIG. 2A and FIG. 2B illustrate the original image 200A (in FIG. 2A) and the corresponding grayscale image 200B (in FIG. 2B). As illustrated in FIG. 2A, original image 200A is partitioned into sub-regions. In some embodiments, the number of partitioned sub-regions in image 200A corresponds to a number of LED groups in a display backlight (for example, in some embodiments, the number of partitioned sub-regions corresponds to a number of LED groups 234 near and/or along a first edge and to a number of LED groups 236 near and/or along a second edge of a backlight display and/or of image 200A). In some embodiments, FIGS. 2A and 2B illustrate, for example, an input image that is partitioned into sub-regions based on 8 groups 236 of backlight LEDs near and/or along a bottom edge of the image 200A and based on 7 groups 234 of backlight LEDs near and/or along a side vertical edge of the image 200A. In some embodiments, groups 234 of backlight LEDs correspond to groups 134 of backlight LEDs in embodiments with 7 groups of LEDs near and/or along a side vertical edge of an image and/or backlight rather than 3 groups of LEDs near and/or along the side vertical edge as illustrated in FIG. 1. In some embodiments, groups 236 of backlight LEDs correspond to groups 136 of backlight LEDs in embodiments with 8 groups of LEDs near and/or along a bottom edge of an image and/or backlight rather than 4 groups of LEDs near and/or along the bottom edge as illustrated in FIG. 1.

In some embodiments, grayscale image 200B of FIG. 2B illustrates a grayscale representation of backlight brightness that may be necessary for each sub-region of the image 200A of FIG. 1 in order to ensure that no image degradation occurs. In some embodiments, backlight brightness that may be needed by a brightest pixel of each sub-region of image 200A and/or of grayscale image 200B may be used as a required brightness value for that sub-region. For example, in some embodiments, a brightness range may be set into a range of brightness levels 0 through 8, where 0 is a darkest level and 8 is a brightest level. In some embodiments, grayscale image 200B illustrates the brightness levels for each of the sub-regions in grayscale, with grayscale levels corresponding to brightness levels 0 through 8.

In some embodiments, FIG. 2C illustrates a numerical representation 200C corresponding to grayscale image 200B sub-regions, with the representative numerical brightness level for each sub-region illustrated in numerical representation 200C in FIG. 2C. Dimming level optimization according to some embodiments is described in reference to the brightness values and ranges illustrated, for example, in FIG. 2C and/or FIG. 2D, and similar dimming level optimization can be implemented according to some embodiments with different brightness values and/or ranges.

In some embodiments, dimming level optimization can be obtained in an efficient manner with low computational cost. In some embodiments, backlight brightness in a particular sub-region (for example, as illustrated in FIG. 2B and FIG. 2C) can be determined by backlight LED groups corresponding to a row and a column of that particular sub-region. In some embodiments, boundary diffusion between LED groups in different rows and columns can be ignored in one or more portions of dimming level control. For example, in some embodiments, boundary diffusion between LED groups in different rows and columns can be ignored in an initial portion of dimming level control. In some embodiments, boundary diffusion between LED groups can be taken into consideration during later portions of dimming level control. In some embodiments, boundary diffusion between LED groups can be taken into consideration during portions of dimming level control such as, for example, dimming level adjustment and/or LCD pixel compensation.

In some embodiments, a two-dimensional (2D) implementation and/or a pseudo-2D implementation can be used to determine initial dimming levels for each LED group. In some embodiments, a variety of different implementations may be used to determine initial dimming levels, and one of the variety of implementations is chosen (for example, based on the implementation that yields a best power saving ratio). In some embodiments, four different implementations can be used to determine initial dimming levels, and one of these four implementations can be selected for use (for example, for use as an initial dimming level). For example, in some embodiments, initial dimming levels can be determined based on one of a number of implementations (for example, one of four implementations) that yields a best power saving ratio. Example implementations are described herein in reference to the example numerical values illustrated in FIG. 2C, for example, where a maximum brightness that a single LED group provides is estimated to be equal to that of the total backlight profile and illustrated as values 0 through 8 as illustrated in FIG. 2C.

In some embodiments, a first dimming level optimization can be implemented, for example, using a two-dimensional (2D) column first approach. In a first portion of the 2D column first approach, for example, a dimming level of each LED group column (for example, an $m^{th}$ column LED group at and/or near an edge such as the bottom edge) is set to a largest number in that column (column m) minus 4 (for example, subtracting half of the maximum level of 8). The dimming level of that LED group column is set to 0 if the result of the subtraction is less than 0. Based on the dimming level of the 8 column LED groups in FIG. 2C, the dimming level would be set to: 4,4,4,4,4,4,3,3 based on the largest number in those columns being respectively: 8,8,8,8,8,8,7,7.

In a second portion of the 2D column first approach, for example, for each sub-region numerical value in FIG. 2C, the dimming level of the corresponding column LED group ($m^{th}$ column LED group) determined in the first portion of the 2D column first approach is subtracted from the FIG. 2C value of that sub-region, and the result is set to 0 if the subtraction result is less than 0. For example, as a result of the second portion of the 2D column first approach, sub-region numerical values 200C from FIG. 2C become the corresponding sub-region numerical values 200D illustrated in FIG. 2D.

In a third portion of the 2D column first approach, for example, for each sub-region numerical value 200D in FIG. 2D, the dimming level of the corresponding row LED group (for example, $n^{th}$ row LED group at the left side edge) is set to the largest number in that row (for example, the $n^{th}$ row) in FIG. 2D. For example, in some embodiments, dimming levels of the 7 row LED groups illustrated in FIG. 2D can result in row dimming values of: 4,4,3,4,4,0,0 (from the top row to the bottom row in FIG. 2D).

In some embodiments, a second dimming level optimization can be implemented, for example, using a two-dimensional (2D) row first approach. In a first portion of the 2D row first approach, for example, a dimming level of each LED group row (for example, an $n^{th}$ row LED group at and/or near an edge such as the left edge) is set to a largest number in that row (row n) minus 4 (for example, subtracting half of the maximum level of 8). The dimming level of that LED group row is set to 0 if the result of the subtraction is less than 0. Based on the dimming level of the 7 row LED groups in FIG. 2C, the dimming level from the top to bottom row would be set to: 4,4,3,4,4,1,0 based on the largest number in those rows being respectively: 8,8,7,8,8,2,0.

In a second portion of the 2D row first approach, for example, for each sub-region numerical value in FIG. 2C, the dimming level of the corresponding row LED group ($n^{th}$ row LED group) determined in the first portion of the 2D row first approach is subtracted from the FIG. 2C value of that sub-region, and the result is set to 0 if the subtraction result is less than 0. For example, as a result of the second portion of the 2D row first approach, sub-region numerical values 200C from FIG. 2C become the corresponding sub-region numerical values 200E illustrated in FIG. 2E.

In a third portion of the 2D column first approach, for example, for each sub-region numerical value 200E in FIG. 2E, the dimming level of the corresponding column LED group (for example, $m^{th}$ column LED group at and/or near the bottom edge) is set to the largest number in that column (for example, the $m^{th}$ column) in FIG. 2E. For example, in some embodiments, dimming levels of the 8 column LED groups illustrated in FIG. 2E can result in column dimming values of: 4,4,4,4,4,4,3,3 (from the left column to the right column in FIG. 2E).

In some embodiments, a third dimming level optimization can be implemented, for example, using a one-dimensional (1 D) column only approach. In some embodiments, a 1D column only approach can include setting the dimming levels of all row LED groups to 0. In some embodiments, a 1D column only approach can include setting a dimming level of each column LED group to a largest number in that column of FIG. 2C. For example, in some embodiments, a 1D column only approach includes setting dimming levels of the 7 rows illustrated in FIG. 2C to: 0,0,0,0,0,0,0 (from top to bottom) and setting dimming levels of the 8 columns illustrated in FIG. 2C to: 8,8,8,8,8,8,7,7 (from left to right).

In some embodiments, a fourth dimming level optimization can be implemented, for example, using a one-dimensional (1 D) row only approach. In some embodiments, a 1D row only approach can include setting the dimming levels of all column LED groups to 0. In some embodiments, a 1D row only approach can include setting a dimming level of each row LED group to a largest number in that row of FIG. 2C. For example, in some embodiments, a 1D row only approach includes setting dimming levels of the 7 rows illustrated in FIG. 2C to: 8,8,7,8,8,2,0 (from top to bottom) and setting dimming levels of the 8 columns illustrated in FIG. 2C to: 0,0,0,0,0,0,0,0 (from left to right).

In some embodiments, for the first dimming level optimization using a 2D column first approach and for the second dimming level optimization using a 2D row first approach, an allowed maximum dimming level for each LED group is 4, since the brightness of a certain pixel is the sum of contributions from the corresponding column and row LED groups. In some embodiments, for the third dimming level optimization using a 1 D column only approach and for the fourth dimming level optimization using a 1 D row only approach, an allowed maximum dimming level for each LED group is 8, since the total brightness of a certain pixel is that of either the corresponding column LED group or the corresponding row LED group, but not both.

In some embodiments, a power saving ratio of each of the four dimming level optimization implementation approaches can be calculated according to:

$$P = \frac{\sum_{i=1}^{N} D_i}{4N} \quad \text{(Equation 1)}$$

where P is the power saving ratio, N is the total number of LED groups in the backlight (including both column and row LED groups), and $D_i$ is the dimming level of the $i^{th}$ LED group. In some embodiments, the denominator 4N on the right side of Equation 1 represents the total power consumption without dimming for a 2D case where all column and row LED groups are assumed to have a dimming level of 4.

In some embodiments, a backlight brightness profile can be calculated (for example, after the initial group LED backlight dimming levels are determined). In some embodiments, the backlight brightness profile includes a total backlight brightness calculated at one or more of the pixels. For example, in some embodiments, the backlight brightness profile includes a total backlight brightness calculated at each pixel.

In some embodiments, once initial LED group backlight dimming levels are determined (for example, according to one or more embodiments as described herein), a total brightness distribution can be calculated based on an actual beam profile of each LED group. For example, in some embodiments, boundary diffusion between all backlight LED groups can be taken into consideration.

Figure 3A:
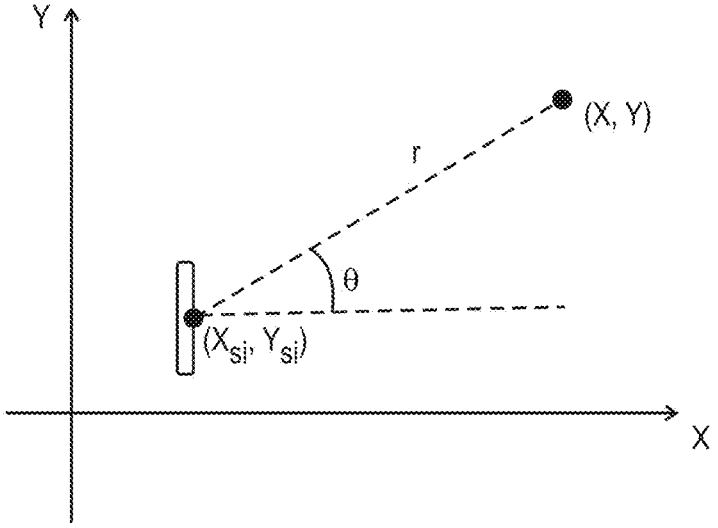
FIG. 3A, FIG. 3B, FIG. 3C, and FIG. 3D, illustrates light beam brightness profile distribution.

FIG. 3A illustrates a beam function 300A of a backlight group. For example, FIG. 3A illustrates an illuminance beam profile function $f_i(r, \theta)$ for an $i^{th}$ backlight LED group. For example, in some embodiments FIG. 3A illustrates a source point ($x_{si}$, $y_{si}$) at a backlight group (represented by the rectangle in FIG. 3A) and a field point (and/or observation point and/or field observation point) (x,y) of an LED light beam profile function. In some embodiments, illuminance beam profile $f_i(r, \theta)$ is determined by optical design. In some embodiments, illuminance beam profile $f_i(r, \theta)$ for the $i^{th}$ backlight LED group is dependent on a distance r between the source point ($x_{si}$, $y_{si}$) and the field point (x, y), and is also dependent on the angle θ illustrated in FIG. 3A. In some embodiments, the angle θ illustrated in FIG. 3A is an angle between two dotted lines illustrated in FIG. 3A—the line between the source point ($x_{si}$, $y_{si}$) and the field point (x, y); and a horizontal line that is parallel with the x axis (and can be perpendicular to a forward face of the backlight group rectangle).

In some embodiments, $$r=\sqrt{(x-x_{si})^2+(y-y_{si})^2} \quad \text{(Equation 2)}$$

In some embodiments, $$\theta=\tan^{-1}[(y-y_{si})/(x-x_{si})] \quad \text{(Equation 3)}$$

Figure 3B:
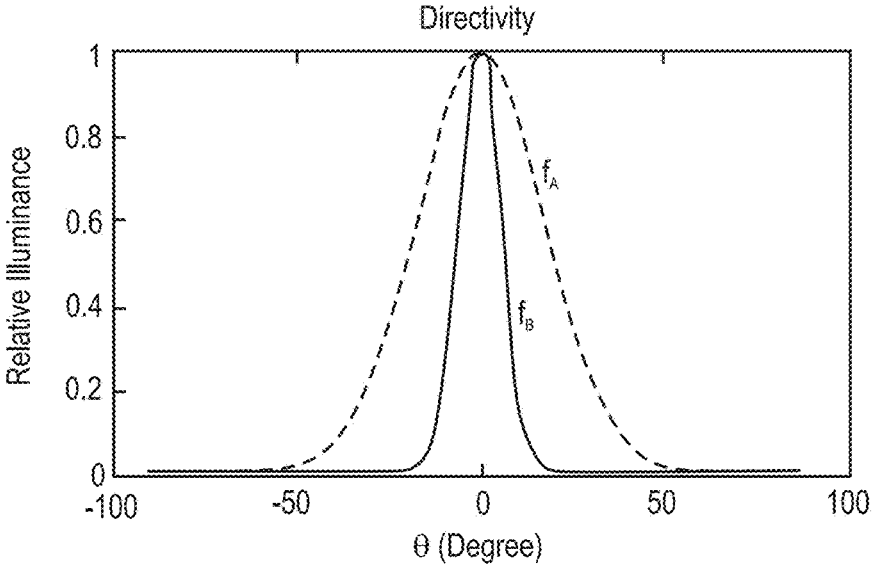
Figure 3C:
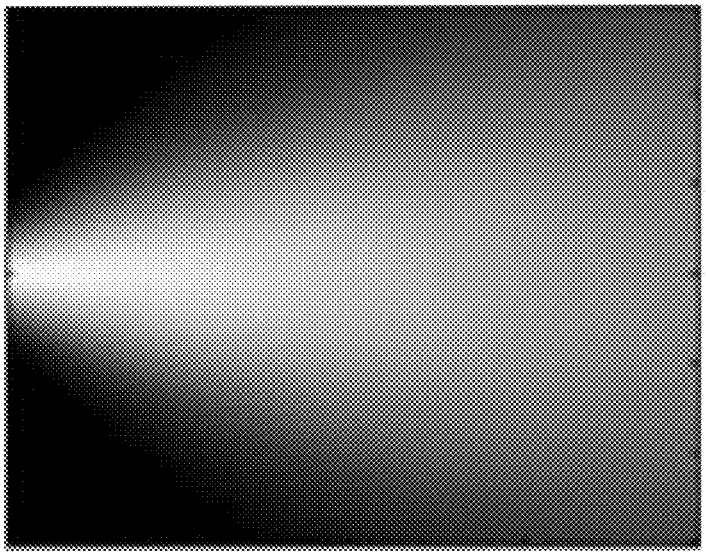
Figure 3D:
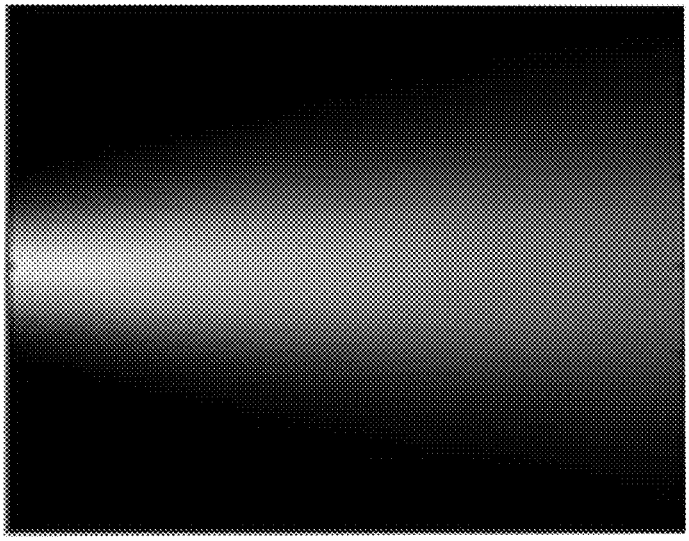

In some embodiments, the backlight brightness profile function and/or illuminance beam profile function for an $i^{th}$ backlight group may also be written as a function of (x,y) and denoted, for example, as $f_i(x,y)$. Two examples of the profile function (backlight brightness profile function and/or illuminance beam profile function) according to some embodiments are illustrated in FIG. 3B (profile function $f_A$ and profile function $f_B$). An example luminance distribution corresponding to example profile function $f_A$ is illustrated in FIG. 3C. An example luminance distribution corresponding to example profile function $f_B$ is illustrated in FIG. 3D.

In some embodiments, a total brightness distribution F(x,y) (and/or total illuminance) can be the superposition of the contribution from each backlight LED group. For example, in some embodiments, a total brightness distribution F(x,y) and/or total illuminance F(x,y) can be the superposition of the contribution from each backlight LED group, according to:

$$F(x, y) = \sum_{i=1}^{N} \frac{D_i}{D_{max}} f_i(x, y) \quad \text{(Equation 4)}$$

where F(x,y) is the total brightness distribution and/or total illuminance (for example, the total luminance of the backlights), N is the total number of backlight LED groups (for example, the total number of vertical and horizontal backlight LED groups), $f_i(x,y)$ is the profile function of an $i^{th}$ backlight LED group (and/or a beam function of the $i^{th}$ backlight LED group), $D_i$ is the dimming level of the $i^{th}$ backlight LED group, and $D_{max}$ is the dimming level at full brightness (and/or the maximum dimming level of the $i^{th}$ backlight LED group), for example. In some embodiments as described herein, the dimming level at full brightness (and/or the maximum dimming level of the backlight LED groups) is 8. In this manner, in some embodiments, the total backlight brightness at each pixel can be calculated.

In some embodiments, a dimming level is adjusted for non-ideal beam profiles. In some embodiments, a dimming level is adjusted for non-ideal beam profiles. In order to ensure that there is no image quality degradation due to backlight dimming, in some embodiments, the following condition can be satisfied:

$$F(x,y) \geq B(x,y) \text{ for all } (x,y) \quad \text{(Equation 5)}$$

where B(x,y) is a minimum brightness required by the image at each pixel, and is determined based on image content (and/or is the minimum total backlight illuminance required by the pixel at (x,y), which is determined by the image).

In some embodiments, a dimming level $D_i$ of the $i^{th}$ backlight group is optimized according to $$\min_{D_i} \sum_{i}^{N} D_i$$

under the condition of Equation 5.

In some embodiments, since initial backlight dimming levels may not be determined based on actual beam profiles, it is possible that Equation 5 may not be true for some pixels. In some embodiments, dimming levels can be adjusted to satisfy Equation 5, while minimally increasing total power.

In some embodiments, dimming levels can be adjusted (for example, to satisfy Equation 5), by identifying pixels where Equation 5 is violated. Pixels where Equation 5 is violated can be referred to in some embodiments as "bad pixels". For each pixel for which Equation 5 is violated (for example, each "bad pixel"), in some embodiments, all backlight LED groups can be identified for which dimming levels can be increased to fix all pixels for which Equation 5 is violated (for example, to fix all "bad pixels"). In some embodiments, a minimum set of backlight LED groups can be determined that can fix all of the pixels for violating Equation 5 (for example, all of the "bad pixels"). In some embodiments, this minimum set of backlight LED groups can be determined using a greedy algorithm. For example, in some embodiments, the minimum set of backlight LED groups can be determined using an algorithmic paradigm that follows a problem-solving heuristic of making a locally optimal choice at each of a number of stages, in order to find a global optimum. In some embodiments, dimming level adjustment for non-ideal beam profiles can be implemented based on groups of pixels rather than based on single pixels. This can be done to improve efficiency, since according to some embodiments, the total backlight brightness profile can be a smooth function of (x,y).

In some embodiments, liquid crystal display (LCD) pixel compensation is implemented. For example, in some embodiments, a final brightness distribution can be calculated using Equation 4. For example, in some embodiments, a final brightness distribution can be calculated using Equation 4 once dimming levels for all backlight LED groups are finally determined after dimming level adjustment. In some embodiments, an actual LCD transmittance ratio $A_{act}(x,y)$ can be calculated as follows:

$$A_{act}(x, y) = B_{max} \frac{A(x, y)}{F(x, y)} \quad \text{(Equation 6)}$$

where A(x,y) is a transmittance ratio without dimming (and/or is the aperture ratio at (x,y) without dimming), and $B_{max}$ is a total brightness value without dimming (and/or the total illuminance value without dimming). In some embodiments, F(x,y) in Equation 6 is the total illuminance at (x,y) based on the optimized dimming level for each backlight group. In some embodiments, $A_{act}(x,y)$ in Equation 6 is the actual aperture ratio at (x,y).

In some embodiments, LCD pixel compensation can be implemented based on groups of pixels rather than based on single pixels. This can be done to improve efficiency, since according to some embodiments, the total backlight brightness profile can be a smooth function of (x,y). In some embodiments, pixel compensation (for example, LCD pixel compensation) can be implemented by adjusting voltage control of image pixels (for example, by adjusting voltage control at an individual image pixel level and/or by small adjusting a number of groups of image pixels in the image).

In some embodiments, dimming level adjustment for non-ideal beam profiles and LCD pixel compensation can both be implemented based on groups of pixels rather than based on single pixels. This can be done to improve efficiency, since according to some embodiments, the total backlight brightness profile can be a smooth function of (x,y). In some embodiments, dimming level adjustment for non-ideal beam profiles and/or pixel compensation can be implemented for each individual pixel in the display image. In some embodiments, dimming level adjustment for non-ideal beam profiles and/or pixel compensation can be implemented for groups of pixels in the display image (for example, for small groups of pixels such as 10 pixels per group, 20 pixels per group, a number of pixels per group that is less than a number of pixels in each sub-region of the backlight and/or the image, or some other number of pixels per group).

Figure 4:
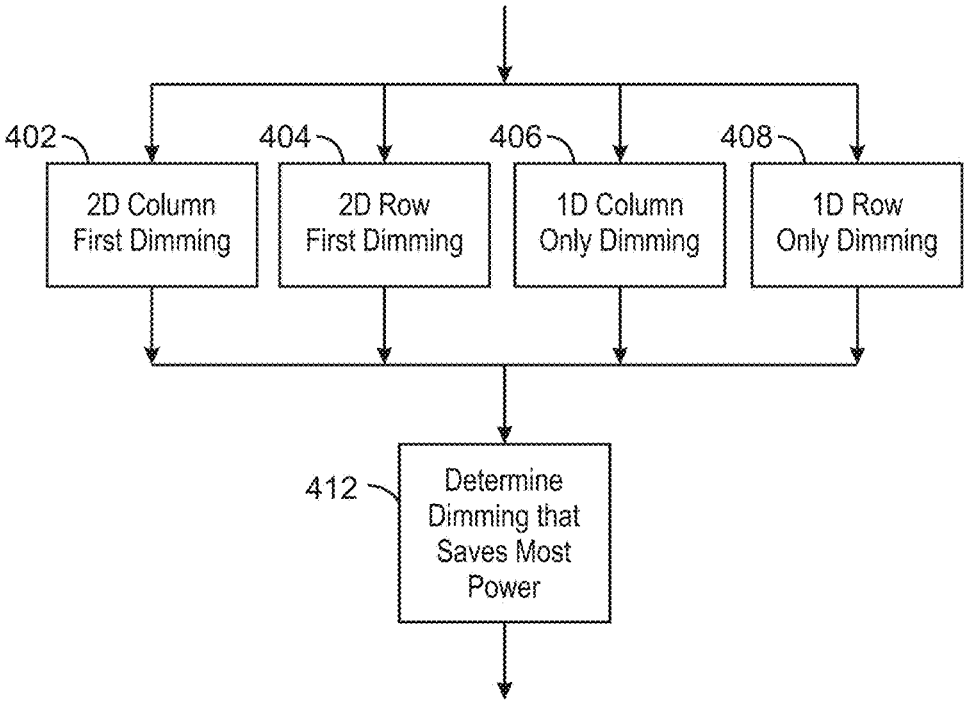
FIG. 4 illustrates display dimming level optimization.

FIG. 4 illustrates dimming level optimization 400 (for example, backlight dimming optimization) according to some embodiments. In some embodiments, dimming level optimization 400 can be implemented in an efficient manner with low computational cost. As discussed above, in some embodiments, backlight brightness in a particular sub-region of the backlight can be determined by backlight LED groups corresponding to a row and a column of that particular sub-region. In some embodiments, dimming level optimization 400 can illustrate an initial portion of dimming level control.

In some embodiments, dimming level optimization 400 can include a two-dimensional (2D) implementation and/or a pseudo-2D implementation that can be used to determine initial dimming levels for each LED group. For example, in some embodiments, a 2D column-first dimming 402 (for example, a 2D column-first backlight dimming 402) is implemented according to some embodiments. In some embodiments, a 2D row-first dimming 404 (for example, a 2D row-first backlight dimming 404) is implemented. In some embodiments, a 1D column only dimming 406 (for example, a 1D column only backlight dimming 406) is implemented. In some embodiments, a 1D row only dimming 408 (for example, a 1D row only backlight dimming 408) is implemented. In some embodiments, 2D column-first dimming 402, 2D row-first dimming 404, 1D column only dimming 406, and 1D row only dimming 408 are implemented in parallel as illustrated in FIG. 4. However, in some embodiments, 2D column-first dimming 402, 2D row-first dimming 404, 1D column only dimming 406, and 1D row only dimming 408 may not be implemented in parallel. In some embodiments, 2D column-first dimming 402, 2D row-first dimming 404, 1D column only dimming 406, and 1D row only dimming 408 are implemented as described elsewhere in this specification. In some embodiments, some of 2D column-first dimming 402, 2D row-first dimming 404, 1D column only dimming 406, and 1D row only dimming 408 may not be included. In some embodiments, other dimming may be implemented (for example, other 1D, 2D, 3D, 4D, etc. dimming). At box 412, it is determined which of the various dimming implementations (for example, which of 2D column-first dimming 402, 2D row-first dimming 404, 1D column only dimming 406, and 1D row only dimming 408) providing dimming that saves the most power (for example, resulting in a best power saving ratio). In some embodiments, the dimming implementation determined in box 412 is used for an initial backlight dimming level result (for example, an initial dimming level for each of a number of backlight LED dimming groups).

In some embodiments, 2D column first dimming 402 and/or 2D row first dimming 404 include 2D dimming control using, for example, both row and column backlights. In some embodiments, 1D column only dimming 406 includes 1D dimming control with column backlights being dimmed. In some embodiments, 1D row only dimming 408 includes 1D dimming control with row backlights being dimmed.

In some embodiments, a variety of different implementations (such as 2D column-first dimming 402, 2D row-first dimming 404, 1D column only dimming 406, and 1D row only dimming 408, for example) may be used to determine initial dimming levels, and one of the variety of implementations is chosen (for example, based on the implementation that yields a best power saving ratio). In some embodiments, four different implementations (such as, for example, 2D column-first dimming 402, 2D row-first dimming 404, 1D column only dimming 406, and 1D row only dimming 408) can be used to determine initial dimming levels, and one of these four implementations can be selected for use (for example, for use as an initial dimming level). For example, in some embodiments, initial dimming levels can be determined based on one of a number of implementations (for example, one of four implementations 2D column-first dimming 402, 2D row-first dimming 404, 1D column only dimming 406, and 1D row only dimming 408) that yields a best power saving ratio.

Figure 5:
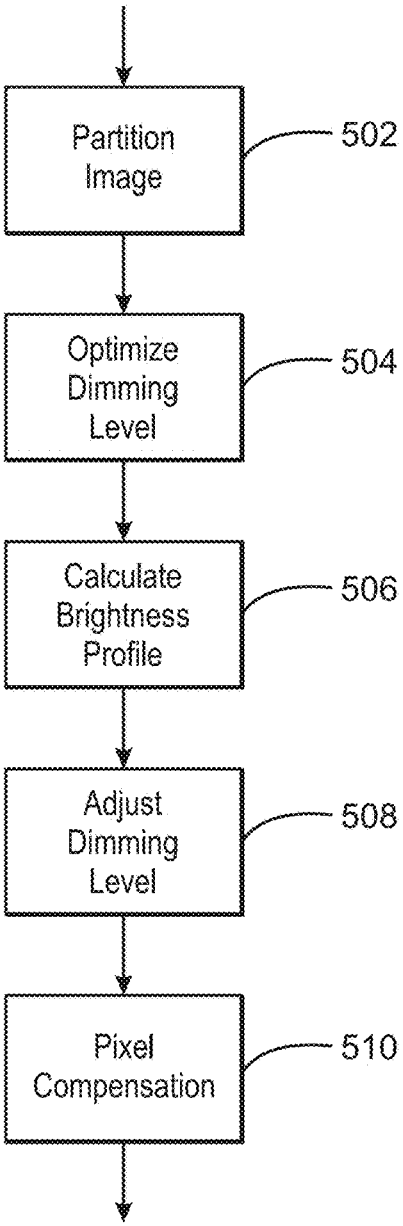
FIG. 5 illustrates display control.

FIG. 5 illustrates display control 500 according to some embodiments. In some embodiments, display control 500 includes backlight display control. In some embodiments, display control 500 includes an initial image partitioning 502 (for example, backlight image partitioning), an initial dimming level optimization 504 (for example, optimization of one or more backlight dimming levels), backlight brightness profile calculation 506, dimming level adjustment 508 (for example, dimming level adjustment for one or more non-ideal beam profiles), and/or pixel compensation 510 (for example, LCD pixel compensation). In some embodiments, initial image partitioning 502, initial dimming level optimization 504, backlight brightness profile calculation 506, dimming level adjustment 508, and/or pixel compensation 510 can be implemented according to any techniques described in this specification. For example, in some embodiments, initial dimming level optimization can be implemented as illustrated in and described in reference to dimming optimization 400 of FIG. 4. In some embodiments, display control 500 can be included in display control 100 illustrated in FIG. 1.

Figure 6:
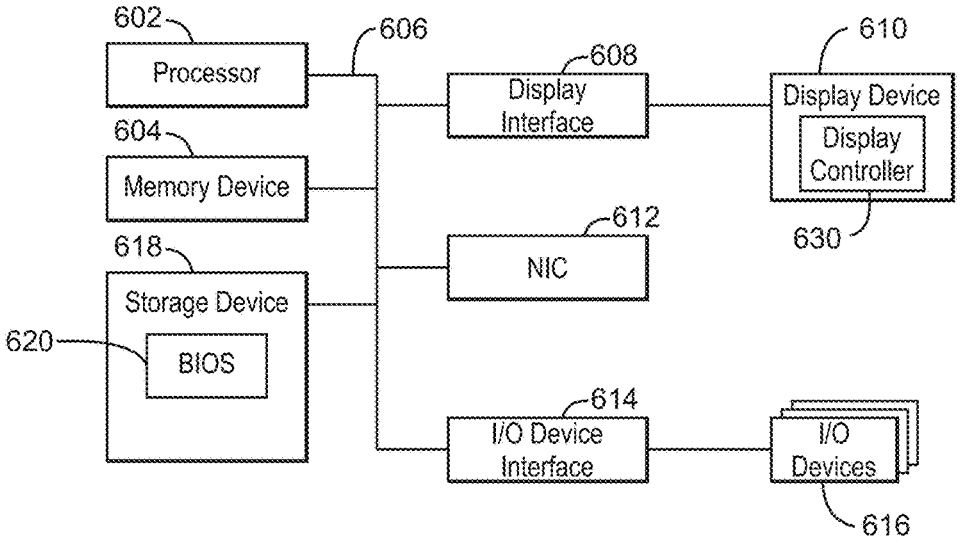
FIG. 6 illustrates a computing device.

FIG. 6 is a block diagram of an example of a computing device 600. In some embodiments, computing device 600 can include display features including one or more of image partitioning, dimming level optimization, backlight brightness profile calculation, dimming level adjustment for non-ideal beam profiles, and/or pixel compensation according to some embodiments. The computing device 600 may be, for example, a mobile device, laptop computer, notebook, tablet, all in one, 2 in 1, and/or desktop computer, etc., among others. The computing device 600 may include a processor 602 that is adapted to execute stored instructions, as well as a memory device 604 (and/or storage device 604) that stores instructions that are executable by the processor 602. The processor 602 can be a single core processor, a multi-core processor, a computing cluster, or any number of other configurations. For example, processor 602 can be an Intel® processor such as an Intel® Celeron, Pentium, Core, Core i3, Core i5, or Core i7 processor. In some embodiments, processor 602 can be an Intel® x86 based processor. In some embodiments, processor 602 can be an ARM based processor. The memory device 604 can be a memory device and/or a storage device, and can include volatile storage, non-volatile storage, random access memory, read only memory, flash memory, and/or any other suitable memory and/or storage systems. The instructions that are executed by the processor 602 may also be used to implement display control and/or display backlight control as described in this specification.

The processor 602 may also be linked through a system interconnect 606 (e.g., PCI®, PCI-Express®, NuBus, etc.) to a display interface 608 adapted to connect the computing device 600 to a display device 610. The display device 610 may include a display screen that is a built-in component of the computing device 600. The display device 610 may also include a computer monitor, television, or projector, among others, that is externally connected to the computing device 600. The display device 610 can include liquid crystal display (LCD), light emitting diodes (LEDs), organic light emitting diodes (OLEDs), and/or micro-LEDs (μLEDs), among others.

In some embodiments, the display interface 608 can include any suitable graphics processing unit, transmitter, port, physical interconnect, and the like. In some examples, the display interface 608 can implement any suitable protocol for transmitting data to the display device 610. For example, the display interface 608 can transmit data using a high-definition multimedia interface (HDMI) protocol, a DisplayPort protocol, or some other protocol or communication link, and the like.

In some embodiments, display device 610 includes a display controller 630. In some embodiments, the display controller 630 can provide control signals within and/or to the display device 610. In some embodiments, display controller 630 can be included in the display interface 608 (and/or instead of the display interface 608). In some embodiments, display controller 630 can be coupled between the display interface 608 and the display device 610. In some embodiments, the display controller 630 can be coupled between the display interface 608 and the interconnect 606. In some embodiments, the display controller 1530 can be included in the processor 1502. In some embodiments, display controller 1530 can implement control of a display and/or a backlight of display device 610 according to any of the examples illustrated in any of the drawings and/or as described anywhere herein.

In some embodiments, any of the techniques described in this specification can be implemented entirely or partially within the display device 610. In some embodiments, any of the techniques described in this specification can be implemented entirely or partially within the display controller 630. In some embodiments, any of the techniques described in this specification can be implemented entirely or partially within the processor 602. In some embodiments, any of the techniques described in this specification can be implemented entirely or partially within a liquid crystal display (LCD) module (for example, which LCD module may be entirely or partially implemented within one or more of processor 602, display interface 608, display device 610, and/or display controller 630).

In addition, a network interface controller (also referred to herein as a NIC) 612 may be adapted to connect the computing device 600 through the system interconnect 606 to a network (not depicted). The network (not depicted) may be a wireless network, a wired network, cellular network, a radio network, a wide area network (WAN), a local area network (LAN), a global position satellite (GPS) network, and/or the Internet, among others.

The processor 602 may be connected through system interconnect 606 to an input/output (I/O) device interface 614 adapted to connect the computing host device 600 to one or more I/O devices 616. The I/O devices 616 may include, for example, a keyboard and/or a pointing device, where the pointing device may include a touchpad or a touchscreen, among others. The I/O devices 616 may be built-in components of the computing device 600, or may be devices that are externally connected to the computing device 600.

In some embodiments, the processor 602 may also be linked through the system interconnect 606 to a storage device 618 that can include a hard drive, a solid state drive (SSD), a magnetic drive, an optical drive, a portable drive, a flash drive, a Universal Serial Bus (USB) flash drive, an array of drives, and/or any other type of storage, including combinations thereof. In some embodiments, the storage device 618 can include any suitable applications. In some embodiments, the storage device 618 can include a basic input/output system (BIOS) 620.

It is to be understood that the block diagram of FIG. 6 is not intended to indicate that the computing device 600 is to include all of the components shown in FIG. 6. Rather, the computing device 600 can include fewer and/or additional components not illustrated in FIG. 6 (e.g., additional memory components, embedded controllers, additional modules, additional network interfaces, etc.). Furthermore, any of the functionalities of the BIOS 620 may be partially, or entirely, implemented in hardware and/or in the processor 602. For example, the functionality may be implemented with an application specific integrated circuit, logic implemented in an embedded controller, or in logic implemented in the processor 602, among others. In some embodiments, the functionalities of the BIOS 620 can be implemented with logic, wherein the logic, as referred to herein, can include any suitable hardware (e.g., a processor, among others), software (e.g., an application, among others), firmware, or any suitable combination of hardware, software, and firmware.

Figure 7:
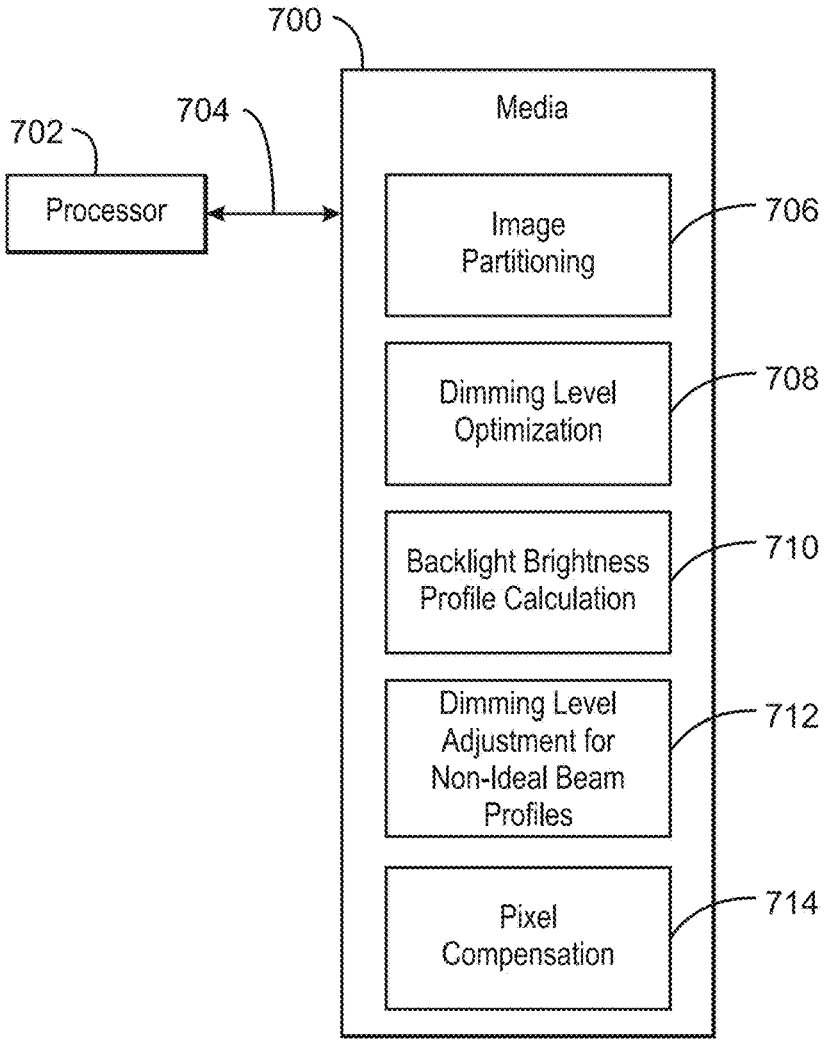
FIG. 7 illustrates one or more processor and one or more tangible, non-transitory, computer-readable media.

FIG. 7 is a block diagram of an example of one or more processor and one or more tangible, non-transitory computer readable media. The one or more tangible, non-transitory, computer-readable media 700 may be accessed by a processor 702 over a computer interconnect 704. Furthermore, the one or more tangible, non-transitory, computer-readable media 700 may include code to direct the processor 702 to perform operations as described herein. For example, in some embodiments, computer-readable media 700 may include code to direct the processor to perform one or more of image partitioning, dimming level optimization, backlight brightness profile calculation, dimming level adjustment for non-ideal beam profiles, and/or pixel compensation according to some embodiments. In some embodiments, processor 702 is one or more processors. In some embodiments, processor 702 can perform similarly to (and/or the same as) processor 602 of FIG. 6, and/or can perform some or all of the same functions as can be performed by processor 602.

Various components discussed in this specification may be implemented using software components. These software components may be stored on the one or more tangible, non-transitory, computer-readable media 700, as indicated in FIG. 7. For example, software components including, for example, computer readable instructions implementing one or more of image partitioning 706, dimming level optimization 708, backlight brightness profile calculation 710, dimming level adjustment for non-ideal beam profiles 712, and/or pixel compensation (for example, LCD pixel compensation) 714 may be included in one or more computer readable media 700 according to some embodiments. Image partitioning 706, dimming level optimization 708, backlight brightness profile calculation 710, dimming level adjustment for non-ideal beam profiles 712, and/or pixel compensation (for example, LCD pixel compensation) 714 may be adapted to direct the processor 702 to perform one or more of any of the operations described in this specification and/or in reference to the drawings.

It is to be understood that any suitable number of the software components shown in FIG. 7 may be included within the one or more tangible, non-transitory computer-readable media 700. Furthermore, any number of additional software components not shown in FIG. 7 may be included within the one or more tangible, non-transitory, computer-readable media 700, depending on the specific application.

In some embodiments, any of the techniques described in this specification and/or illustrated in the drawings can be implemented in a liquid crystal display (LCD) module. In some embodiments, any of the techniques described in this specification and/or illustrated in the drawings can be implemented in a graphics driver. In some embodiments, any of the techniques described in this specification and/or illustrated in the drawings can be implemented in a mobile and/or portable computing device (for example, in an LCD module of a mobile and/or portable computing device). In some embodiments, techniques described herein can help to improve battery life and/or display quality (for example, in a mobile and/or portable computing device).

Reference in the specification to "one embodiment" or "an embodiment" or "some embodiments" of the disclosed subject matter means that a particular feature, structure, or characteristic described in connection with the embodiment is included in at least one embodiment of the disclosed subject matter. Thus, the phrase "in one embodiment" or "in some embodiments" may appear in various places throughout the specification, but the phrase may not necessarily refer to the same embodiment or embodiments.

Example 1

In some examples, a display includes a plurality of display backlight groups and one or more controller. The one or more controller is to determine one or more one-dimensional backlight group brightness level adjustments, to determine one or more two-dimensional backlight group brightness level adjustments, and to adjust a brightness of one or more of the backlight groups in response to content of a display image.

Example 2

In some examples, the display of Example 1, where the display backlight groups each include a plurality of light-emitting diodes.

Example 3

In some examples, the display of Example 1, where the display includes a display panel. The plurality of display backlight groups includes a plurality of display backlight groups at or near a first edge of the display panel. The plurality of display backlight groups also includes a plurality of display backlight groups at or near a second edge of the display panel.

Example 4

In some examples, the display of Example 1, where one or more of the controllers is to dim the brightness of one or more of the backlight groups in response to the content of the display image.

Example 5

In some examples, the display of Example 1, including a controller to adjust a brightness of one or more pixels in the display image in response to the adjusted brightness of the one or more of the display backlight groups.

Example 6

In some examples, the display of Example 1, one or more of the controllers to adjust the brightness by selecting one of a plurality of backlight adjustment level determinations. The selected one of the plurality of backlight adjustment level determinations is to be selected based on a maximum power savings.

Example 7

In some examples, the display of Example 6, the controller to adjust the brightness by selecting one or more of the one or more determined one-dimensional backlight group determination, or one or more of the one or more determined two-dimensional backlight group determination.

Example 8

In some examples, the display of Example 1, where the one or more determined one-dimensional backlight group brightness level adjustments includes a row only adjustment and a column only adjustment, and the determined one or more two-dimensional backlight group brightness level adjustments includes a row first adjustment and a column first adjustment.

Example 9

In some examples, the display of Example 1, one or more of the controllers to calculate a backlight brightness profile in response to the backlight brightness adjustment and in response to a boundary diffusion between the backlight groups.

Example 10

In some examples, the display of Example 1, one or more of the controllers to adjust for non-ideal beam profiles in response to the backlight brightness adjustment.

Example 11

In some examples, an apparatus to control a display that includes a plurality of display backlight groups. The apparatus includes an interface to communicatively couple the apparatus to the display, and one or more controller to determine one or more one-dimensional backlight group brightness level adjustments, to determine one or more two-dimensional backlight group brightness level adjustments, and to adjust a brightness of one or more of the display backlight groups in response to content of an image to be displayed on the display.

Example 12

In some examples, the apparatus of Example 11, where the one or more controller is to dim the brightness of one or more of the backlight groups in response to the content of the image.

Example 13

In some examples, the apparatus of Example 11, including a controller to adjust a brightness of one or more pixels in the display image in response to the adjusted brightness of the one or more of the display backlight groups.

Example 14

In some examples, the apparatus of Example 11, the one or more controller to adjust the brightness by selecting one of a plurality of backlight adjustment level determinations. The selected one of the plurality of backlight adjustment level determinations is to be selected based on a maximum power savings.

Example 15

In some examples, the apparatus of Example 14, the controller to adjust the brightness by selecting one or more of one or more of the one or more determined one-dimensional backlight group brightness level adjustments, or one or more of the one or more determined two-dimensional backlight group brightness level adjustments.

Example 16

In some examples, the apparatus of Example 1, where the one or more determined one-dimensional backlight group brightness level adjustments includes a row only adjustment and a column only adjustment, and wherein the one or more determined two-dimensional backlight group brightness level adjustments includes a row first adjustment and a column first adjustment.

Example 17

In some examples, the apparatus of Example 11, one or more of the controllers to calculate a backlight brightness profile in response to the backlight brightness adjustment and in response to a boundary diffusion between the backlight groups.

Example 18

In some examples, the apparatus of Example 11, one or more of the controllers to adjust for non-ideal beam profiles in response to the backlight brightness adjustment.

Example 19

In some examples, a method to control a display. The method includes controlling a brightness of a plurality of display backlight groups of the display. The method further includes determining one or more one-dimensional backlight group brightness level adjustments, and determining one or more two-dimensional backlight group brightness level adjustments. The method also includes adjusting the brightness of one or more of the display backlight groups in response to content of an image to be displayed on the display.

Example 20

In some examples, the method of Example 19, including dimming the brightness of the one or more of the backlight groups in response to the content of the image.

Example 21

In some examples, the method of Example 19, including adjusting a brightness of one or more pixels in the display image in response to the adjusted brightness of the one or more of the display backlight groups.

Example 22

In some examples, the method of Example 19, including adjusting the brightness of the plurality of display backlight groups by selecting one of a plurality of backlight adjustment level determinations. The selected one of the plurality of backlight adjustment level determinations is to be selected based on a maximum power savings.

Example 23

In some examples, one or more tangible, non-transitory machine readable media including a plurality of instructions. The plurality of instructions, in response to being executed on at least one processor, cause the at least one processor to control a brightness of a plurality of display backlight groups of the display, to determine one or more one-dimensional backlight group brightness level adjustments, to determine one or more two-dimensional backlight group brightness level adjustments, and to adjust the brightness of one or more of the display backlight groups in response to content of an image to be displayed on the display.

Example 24

In some examples, the one or more tangible, non-transitory machine readable media of Example 23, including a plurality of instructions that, in response to being executed on at least one processor, cause the at least one processor to adjust a brightness of one or more pixels in the display image in response to the adjusted brightness of the one or more of the display backlight groups.

Example 25

In some examples, the one or more tangible, non-transitory machine readable media of Example 23, including a plurality of instructions that, in response to being executed on at least one processor, cause the at least one processor to adjust the brightness by selecting one of a plurality of backlight adjustment level determinations. The selected one of the plurality of backlight adjustment level determinations is to be selected based on a maximum power savings.

Example 26

In some examples, a display includes a plurality of display backlight groups and one or more controller. The one or more controller is to determine one or more one-dimensional backlight group brightness level adjustments, to determine one or more two-dimensional backlight group brightness level adjustments, and to adjust a brightness of one or more of the backlight groups in response to content of a display image.

Example 27

In some examples, the display of Example 26, the display backlight groups each including a plurality of light-emitting diodes.

Example 28

In some examples, the display of Example 26 or 27, the display including a display panel. The plurality of display backlight groups include a plurality of display backlight groups at or near a first edge of the display panel and a plurality of display backlight groups at or near a second edge of the display panel.

Example 29

In some examples, the display of any of Examples 26-28, where the controller is to dim the brightness of one or more of the backlight groups in response to the content of the display image.

Example 30

In some examples, the display of any of Examples 26-29, including a controller to adjust a brightness of one or more pixels in the display image in response to the adjusted brightness of the one or more of the display backlight groups.

Example 31

In some examples, the display of any of Examples 26-30, where one or more of the controllers is to adjust the brightness by selecting one of a plurality of backlight adjustment level determinations. The selected one of the plurality of backlight adjustment level determinations is to be selected based on a maximum power savings.

Example 32

In some examples, the display of any of Examples 26-31. The controller is to adjust the brightness by selecting one or more of the one or more determined one-dimensional backlight group brightness level adjustments, or one or more two-dimensional backlight group brightness level adjustments.

Example 33

In some examples, the display of any of Examples 26-32, where the one or more determined one-dimensional backlight group brightness level adjustments includes a row only adjustment and a column only adjustment, and where the one or more two-dimensional backlight group brightness level adjustments includes a row first adjustment and a column first adjustment.

Example 34

In some examples, the display of any of Examples 26-33, where one or more of the controllers is to calculate a backlight brightness profile in response to the backlight brightness adjustment and in response to a boundary diffusion between the backlight groups.

Example 35

In some examples, the display of any of Examples 26-34, where one or more of the controllers is to adjust for non-ideal beam profiles in response to the backlight brightness adjustment.

Example 36

In some examples, an apparatus to control a display that includes a plurality of display backlight groups. The apparatus includes means to determine one or more one-dimensional backlight group brightness level adjustments, and means to determine one or more two-dimensional backlight group brightness level adjustments. The apparatus also includes means to adjust a brightness of one or more of the display backlight groups in response to content of an image to be displayed on the display.

Example 37

In some examples, the apparatus of Example 36, including means to dim the brightness of one or more of the backlight groups in response to the content of the image.

Example 38

In some examples, the apparatus of any of Examples 36-37, including means to adjust a brightness of one or more pixels in the display image in response to the adjusted brightness of the one or more of the display backlight groups.

Example 39

In some examples, the apparatus of any of Examples 36-38, including means to adjust the brightness of the one or more of the display backlight groups by selecting one of a plurality of backlight adjustment level determinations based on a maximum power savings.

Example 40

In some examples, the apparatus of any of Examples 36-39, including means to adjust the brightness of the one or more of the display backlight groups by selecting one or more of one or more of the determined one-dimensional backlight group brightness level adjustments, or one or more of the determined two-dimensional backlight group brightness level adjustments.

Example 41

In some examples, the apparatus of any of Examples 36-40, where the one or more determined one-dimensional backlight group brightness level adjustments includes a row only adjustment and a column only adjustment, and where the one or more determined two-dimensional backlight group brightness level adjustments includes a row first adjustment and a column first adjustment.

Example 42

In some examples, the apparatus of any of Examples 36-41, including means to calculate a backlight brightness profile in response to the backlight brightness adjustment and in response to a boundary diffusion between the backlight groups.

Example 43

In some examples, the apparatus of any of Examples 36-42, including means to adjust for non-ideal beam profiles in response to the backlight brightness adjustment.

Example 44

In some examples, a method to control a display, including controlling a brightness of a plurality of display backlight groups of the display, and adjusting the brightness of one or more of the display backlight groups in response to content of an image to be displayed on the display. The method also includes determining one or more one-dimensional backlight group brightness level adjustments, and determining one or more two-dimensional backlight group brightness level adjustments.

Example 45

In some examples, the method of Example 44, including dimming the brightness of the one or more of the backlight groups in response to the content of the image.

Example 46

In some examples, the method of any of Examples 44-45, including adjusting a brightness of one or more pixels in the display image in response to the adjusted brightness of the one or more of the display backlight groups.

Example 47

In some examples, the method of any of Examples 44-46, including adjusting the brightness of the one or more of the display backlight groups by selecting one of a plurality of backlight adjustment level determinations. The selected one of the plurality of backlight adjustment level determinations is to be selected based on a maximum power savings.

Example 48

In some examples, one or more tangible, non-transitory machine readable media including a plurality of instructions. In response to being executed on at least one processor, the instructions cause the at least one processor to control a brightness of a plurality of display backlight groups of the display, to determine one or more one-dimensional backlight group brightness level adjustments, to determine one or more two-dimensional backlight group brightness level adjustments, and to adjust the brightness of one or more of the display backlight groups in response to content of an image to be displayed on the display.

Example 49

In some examples, the one or more tangible, non-transitory machine readable media of Example 48, including a plurality of instructions that, in response to being executed on at least one processor, cause the at least one processor to adjust a brightness of one or more pixels in the display image in response to the adjusted brightness of the one or more of the display backlight groups.

Example 50

In some examples, the one or more tangible, non-transitory machine readable media of any of Examples 48-49, including a plurality of instructions that, in response to being executed on at least one processor, cause the at least one processor to adjust the brightness by selecting one of the determined backlight adjustment levels. The selected one of the plurality of backlight adjustment levels is to be selected based on a maximum power savings.

Example 51

In some examples, an apparatus to control a display that includes a plurality of display backlight groups. The apparatus includes an interface to communicatively couple the apparatus to the display, and one or more controller to determine one or more one-dimensional backlight group brightness level adjustments, to determine one or more two-dimensional backlight group brightness level adjustments, and to adjust the brightness of one or more of the display backlight groups in response to content of an image to be displayed on the display.

Example 52

In some examples, the apparatus of Example 51, where the controller is to dim the brightness of one or more of the backlight groups in response to the content of the image.

Example 53

In some examples, the apparatus of any of Examples 51-52, including a controller to adjust a brightness of one or more pixels in the display image in response to the adjusted brightness of the one or more of the display backlight groups.

Example 54

In some examples, the apparatus of any of Examples 51-53, one or more of the controllers to adjust the brightness by selecting one of the determined backlight group brightness level adjustments. The selected one of the plurality of backlight group adjustment levels is to be selected based on a maximum power savings.

Example 55

In some examples, the apparatus of any of Examples 51-54, one or more of the controllers to adjust the brightness by selecting one or more of the one or more determined one-dimensional backlight group brightness level adjustments, or one or more of the one or more determined two-dimensional backlight group brightness level adjustments.

Example 56

In some examples, the apparatus of any of Examples 51-55, where the one or more determined one-dimensional backlight group brightness level adjustments includes a row only adjustment and a column only adjustment, and wherein the one or more determined two-dimensional backlight group brightness level adjustments includes a row first adjustment and a column first adjustment.

Example 57

In some examples, the apparatus of any of Examples 51-56, the controller to calculate a backlight brightness profile in response to the backlight brightness adjustment and in response to a boundary diffusion between the backlight groups.

Example 58

In some examples, the apparatus of any of Examples 51-57, the controller to adjust for non-ideal beam profiles in response to the backlight brightness adjustment.

Example 59

In some examples, the method of Example 47, including adjusting the brightness by selecting one or more one-dimensional backlight group determination, or one or more two-dimensional backlight group determination.

Example 60

In some examples, the method of Example 59, where the one or more one-dimensional backlight group determination includes a row only determination and a column only determination, and where the one or more two-dimensional backlight group determination includes a row first determination and a column first determination.

Example 61

In some examples, the method of any of Examples 44-46, including calculating a backlight brightness profile in response to the backlight brightness adjustment and in response to a boundary diffusion between the backlight groups.

Example 62

In some examples, a method to control a display. The method includes controlling a brightness of a plurality of display backlight groups of the display. The method further includes determining one or more one-dimensional backlight group brightness level adjustments, and determining one or more two-dimensional backlight group brightness level adjustments. The method also includes adjusting the brightness of one or more of the display backlight groups in response to content of an image to be displayed on the display.

Example 63

In some examples, the method of any preceding Example, where the display backlight groups each include a plurality of light-emitting diodes.

Example 64

In some examples, the method of any preceding Example, where the display includes a display panel. The plurality of display backlight groups includes a plurality of display backlight groups at or near a first edge of the display panel and a plurality of display backlight groups at or near a second edge of the display panel.

Example 65

In some examples, the method of any preceding Example, including dimming the brightness of the one or more of the backlight groups in response to the content of the image.

Example 66

In some examples, the method of any preceding Example, including adjusting a brightness of one or more pixels in the display image in response to the adjusted brightness of the one or more of the display backlight groups.

Example 67

In some examples, the method of any preceding Example, including adjusting the brightness of the one or more of the display backlight groups by selecting one of a plurality of backlight adjustment level determinations. The selected one of the plurality of backlight adjustment level determinations is to be selected based on a maximum power savings.

Example 68

In some examples, the method of any preceding Example, including adjusting the brightness by selecting one or more of one or more of the determined one-dimensional backlight group brightness level adjustments, or one or more of the determined two-dimensional backlight group brightness level adjustments.

Example 69

In some examples, the method of any preceding Example, where the one or more one-dimensional backlight group brightness level adjustments includes a row only adjustment and a column only adjustment, and where the one or more two-dimensional backlight group brightness level adjustments includes a row first adjustment and a column first adjustment.

Example 70

In some examples, the method of any preceding Example, including calculating a backlight brightness profile in response to the backlight brightness adjustment and in response to a boundary diffusion between the backlight groups.

Example 71

In some examples, the method of any preceding Example, including adjusting for non-ideal beam profiles in response to the backlight brightness adjustment.

Example 72

In some examples, an apparatus including means to perform a method as in any preceding Example.

Example 73

In some examples, a display including a plurality of display backlight groups. The display includes means to perform a method or realize an apparatus as in any preceding Example.

Example 74

In some examples, machine-readable storage including machine-readable instructions, when executed, to implement a method or realize an apparatus as in any preceding Example.

Although example embodiments of the disclosed subject matter are described with reference to circuit diagrams, flow diagrams, block diagrams etc. in the drawings, persons of ordinary skill in the art will readily appreciate that many other ways of implementing the disclosed subject matter may alternatively be used. For example, the arrangements of the elements in the diagrams, and/or the order of execution of the blocks in the diagrams may be changed, and/or some of the circuit elements in circuit diagrams, and blocks in block/flow diagrams described may be changed, eliminated, or combined. Any elements as illustrated and/or described may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted. Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, one or more volatile and/or non-volatile memory devices, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine-readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter. For example, in each illustrated embodiment and each described embodiment, it is to be understood that the diagrams of the figures and the description herein is not intended to indicate that the illustrated or described devices include all of the components shown in a particular figure or described in reference to a particular figure. In addition, each element may be implemented with logic, wherein the logic, as referred to herein, can include any suitable hardware (e.g., a processor, among others), software (e.g., an application, among others), firmware, or any suitable combination of hardware, software, and firmware, for example.

What is claimed is:

1. A display comprising:

a plurality of display backlight groups; and one or more controller to:

determine one or more one-dimensional backlight group brightness level adjustments;

determine one or more two-dimensional backlight group brightness level adjustments;

select a backlight group brightness level adjustment from the one or more one-dimensional backlight group brightness level adjustments and the one or more two-dimensional backlight group brightness level adjustments, wherein the selected backlight group brightness level adjustment is the backlight group brightness level adjustment of the one or more one-dimensional backlight group brightness level adjustments and the one or more two-dimensional backlight group brightness level adjustments that yields a best power saving ratio;

dim the display backlight groups based on the selected backlight group brightness level adjustment; and adjust a brightness of one or more of the backlight groups in response to content of a display image.

2. The display of claim 1, the display backlight groups each comprising a plurality of light-emitting diodes.

3. The display of claim 1, the display including a display panel, the plurality of display backlight groups comprising a plurality of display backlight groups at or near a first edge of the display panel and a plurality of display backlight groups at or near a second edge of the display panel.

4. The display of claim 1, wherein one or more of the controllers is to dim the brightness of one or more of the backlight groups in response to the content of the display image.

5. The display of claim 1, comprising a controller to adjust a brightness of one or more pixels in the display image in response to the adjusted brightness of the one or more of the display backlight groups.

6. The display of claim 1, one or more of the controllers to adjust the brightness by selecting one of a plurality of backlight adjustment level determinations, the selected one of the plurality of backlight adjustment level determinations to be selected based on a maximum power savings.

7. The display of claim 6, one or more of the controllers to adjust the brightness by selecting one or more of:

one or more of the one or more determined one-dimensional backlight group brightness level adjustments; or one or more of the one or more determined two-dimensional backlight group brightness level adjustments.

8. The display of claim 1, wherein the one or more determined one-dimensional backlight group brightness level adjustments includes a row only adjustment and a column only adjustment, and wherein the determined one or more two-dimensional backlight group brightness level adjustments includes a row first adjustment and a column first adjustment.

9. The display of claim 1, one or more of the controllers to calculate a backlight brightness profile in response to the backlight brightness adjustment and in response to a boundary diffusion between the backlight groups.

10. The display of claim 1, one or more of the controllers to adjust for non-ideal beam profiles in response to the backlight brightness adjustment.

11. An apparatus to control a display that includes a plurality of display backlight groups, the apparatus comprising:

an interface to communicatively couple the apparatus to the display; and one or more controller to:

determine one or more one-dimensional backlight group brightness level adjustments;

determine one or more two-dimensional backlight group brightness level adjustments;

select a backlight group brightness level adjustment from the one or more one-dimensional backlight group brightness level adjustments and the one or more two-dimensional backlight group brightness level adjustments, wherein the selected backlight group brightness level adjustment is the backlight group brightness level adjustment of the one or more one-dimensional backlight group brightness level adjustments and the one or more two-dimensional backlight group brightness level adjustments that yields a best power saving ratio;

dim the display backlight groups based on the selected backlight group brightness level adjustment; and adjust a brightness of one or more of the display backlight groups in response to content of an image to be displayed on the display.

12. The apparatus of claim 11, wherein one or more of the controllers is to dim the brightness of one or more of the backlight groups in response to the content of the image.

13. The apparatus of claim 11, comprising a controller to adjust a brightness of one or more pixels in the display image in response to the adjusted brightness of the one or more of the display backlight groups.

14. The apparatus of claim 11, one or more of the controllers to adjust the brightness by selecting one of a plurality of backlight adjustment level determinations, the selected one of the plurality of backlight adjustment level determinations to be selected based on a maximum power savings.

15. The apparatus of claim 14, one or more of the controllers to adjust the brightness by selecting one or more of:

one or more of the one or more determined one-dimensional backlight group brightness level adjustments; or one or more of the one or more determined two-dimensional backlight group brightness level adjustments.

16. The apparatus of claim 11, wherein the one or more determined one-dimensional backlight group brightness level adjustments includes a row only adjustment and a column only adjustment, and wherein the one or more determined two-dimensional backlight group brightness level adjustments includes a row first adjustment and a column first adjustment.

17. The apparatus of claim 11, one or more of the controllers to calculate a backlight brightness profile in response to the backlight brightness adjustment and in response to a boundary diffusion between the backlight groups.

18. The apparatus of claim 11, one or more of the controllers to adjust for non-ideal beam profiles in response to the backlight brightness adjustment.

19. A method to control a display, comprising:

controlling a brightness of a plurality of display backlight groups of the display;

determining one or more one-dimensional backlight group brightness level adjustments;

determining one or more two-dimensional backlight group brightness level adjustments;

selecting a backlight group brightness level adjustment from the one or more one-dimensional backlight group brightness level adjustments and the one or more two-dimensional backlight group brightness level adjustments, wherein the selected backlight group brightness level adjustment is the backlight group brightness level adjustment of the one or more one-dimensional backlight group brightness level adjustments and the one or more two-dimensional backlight group brightness level adjustments that yields a best power saving ratio;

dimming the display backlight groups based on the selected backlight group brightness level adjustment; and adjusting the brightness of one or more of the display backlight groups in response to content of an image to be displayed on the display.

20. The method of claim 19, comprising dimming the brightness of the one or more of the backlight groups in response to the content of the image.

21. The method of claim 19, comprising adjusting a brightness of one or more pixels in the display image in response to the adjusted brightness of the one or more of the display backlight groups.

22. The method of claim 19, comprising adjusting the brightness of the one or more of the display backlight groups by selecting one of a plurality of backlight adjustment level determinations, the selected one of the plurality of backlight adjustment level determinations to be selected based on a maximum power savings.

23. One or more tangible, non-transitory machine readable media comprising a plurality of instructions that, in response to being executed on at least one processor, cause the at least one processor to:

control a brightness of a plurality of display backlight groups of the display;

determine one or more one-dimensional backlight group brightness level adjustments;

determine one or more two-dimensional backlight group brightness level adjustments;

select a backlight group brightness level adjustment from the one or more one-dimensional backlight group brightness level adjustments and the one or more two-dimensional backlight group brightness level adjustments, wherein the selected backlight group brightness level adjustment is the backlight group brightness level adjustment of the one or more one-dimensional backlight group brightness level adjustments and the one or more two-dimensional backlight group brightness level adjustments that yields a best power saving ratio;

dim the display backlight groups based on the selected backlight group brightness level adjustment; and adjust the brightness of one or more of the display backlight groups in response to content of an image to be displayed on the display.

24. The one or more tangible, non-transitory machine readable media of claim 23, comprising a plurality of instructions that, in response to being executed on at least one processor, cause the at least one processor to adjust a brightness of one or more pixels in the display image in response to the adjusted brightness of the one or more of the display backlight groups.

25. The one or more tangible, non-transitory machine readable media of claim 23, comprising a plurality of instructions that, in response to being executed on at least one processor, cause the at least one processor to adjust the brightness by selecting one of a plurality of backlight adjustment level determinations, the selected one of the plurality of backlight adjustment level determinations to be selected based on a maximum power savings.

* * * * *